United States Patent [19]

Figlia et al.

[11] Patent Number: 4,982,171

[45] Date of Patent: Jan. 1, 1991

[54] COAXIAL-WAVEGUIDE PHASE SHIFTER

[75] Inventors: Giuseppe Figlia, Turin; Davide Forigo, Orbassano; Flavio Mercurio; Dario Savini, both of Turin, all of Italy

[73] Assignee: Cselt - Centro Studi E Laboratori Telecomunicazioni S.p.A., Turin, Italy

[21] Appl. No.: 384,743

[22] Filed: Jul. 24, 1989

[30] Foreign Application Priority Data

Sep. 2, 1988 [IT] Italy ..... 67787A/88

[51] Int. Cl.[5] ..... H01P 1/18

[52] U.S. Cl. ..... 333/157; 333/135; 333/160

[58] Field of Search ..... 333/156, 157, 160, 126, 333/135, 137, 21 A, 218, 251, 33

[56] References Cited

U.S. PATENT DOCUMENTS

| | | | |
|---|---|---|---|
| 2,783,440 | 2/1957 | Lovick, Jr. | 333/248 |
| 3,413,642 | 11/1968 | Cook | 333/21 R |
| 4,504,805 | 3/1985 | Ekelman, Jr. et al. | 333/135 X |
| 4,725,795 | 2/1988 | Ajioka et al. | 333/157 X |

FOREIGN PATENT DOCUMENTS

| | | | |
|---|---|---|---|
| 0077702 | 5/1984 | Japan | 333/157 |

*Primary Examiner*—Eugene R. LaRoche
*Assistant Examiner*—Seung Ham
*Attorney, Agent, or Firm*—Herbert Dubno

[57] ABSTRACT

The coaxial-waveguide phase shifter consists of a coaxial waveguide section, comprising an external cylindrical conductor and an internal cylindrical conductor, both hollow. Between them a number of irises are provided parallel to one another. The irises can be differently shaped and can be fixed to the external or to the internal conductor. By replacing the internal cylindrical conductor with a rectangular conductor, the irises can be unnecessary.

6 Claims, 1 Drawing Sheet

COAXIAL-WAVEGUIDE PHASE SHIFTER

FIELD OF THE INVENTION

The present invention relates to devices for telecommunications systems operating with microwaves and, more particularly to a coaxial-waveguides phase shifter.

As is known, coaxial waveguides consist of a hollow cylindrical conductor into which a second cylindrical conductor is inserted, which is also hollow and coaxial with the external conductor.

These guides are used whenever mode TE11 propagation of signals belonging to two different frequency bands, which can be very distant from each other, is desired. In fact, the internal conductor acts as a conventional circular waveguide through which signals belonging to the higher frequency band propagate, which the region comprised between the external conductor and the internal one acts as a waveguide through which signals belonging to the lower frequency band propagate. In addition, the coaxial waveguide has a pass band, i.e. the band between cutoff frequency of mod TE11 and the frequency of the first higher mode, which is wider than the band of the circular waveguide with the same diameter.

Of course, the addition of one or more external cylindrical conductors allows the addition of a corresponding number of frequency bands propagating in the fundamental mode. A large amount of information can thus be transmitted, which can be further doubled by using signals belonging to the same frequency band but with different polarizations.

Analogously to what already devised for circular waveguide sytems, which is hence well known, it has also been necessary to provide for coaxial waveguides devices capable of conveniently handling microwave signals propagating inside them. More particularly, discriminating devices are required since signals belonging to the same frequency band, but with different polarizations (namely orthogonal or with opposite rotation directions), are transmitted through the same guide. Among these devices are phase shifters, and chiefly phase shifter yielding different electrical behaviors in the presence of different-polarization signals. With these devices, high performance microwave components can be obtained, such as double-polarization multiband feeders for ground station or satellite antennas to be used in telecommunications or in radioastronomy.

In applications of this kind a phase shifter can be used to convert a circular polarization signal into a linear polarization signal, thus operating as a polarizer with a 90 phase shift, or for rotating the polarization of a linearly polirized signal, keeping the polarization linear. In this case, the phase shift introduced must be of 180° A polarizer with a 90° with shift also allows the separation of circularly polarized signals with opposite rotation directions, supplying two linearly-polarized orthogonal signals, which can easily be separated.

Phase shifters in rectangular or circular waveguides are already known in the literature. A circular waveguide phase shifter has been described in the article entitled "Poralization diversity lower antenna feed-line noise", by Howard C. Yates et al, issued in Microwaves, May 1968. It consists of a circular waveguide section containing cascaded irises, composed of two equal circular segments in opposition. A total phase shift of 90 or 180 degrees is obtained by disturbing the phase shift conveniently on the different irises, generally placed at a quarter-wave spacing at the design-center frequency. Bandwidths of an octave obtained for 90°±1° phase shifts.

The performances criteria required of these components can be thus summarized:

bandwidth of at least 12% of the center frequency; return looses less than 30 dB;

differential phase shift between orthogonal polarizations of ±1°; axial ratio less than 1.02, in the case of circular polarization.

For applications of board a satellite light-weight and small-size devices are also required. This means that the optimum number of irises for the phase shifter should be ascertained, since the total length of the device depends on this number.

In the known phase shifters, designed for circular waveguide systems, the desired bandwidths were obtained by using a rather large number of irises; hence the structures obtained are cumbersome.

SUMMARY OF THE INVENTION

The drawbacks described above are overcome by the coaxial-waveguide phase shifter, provided by the present invention, which has the above-mentioned performance, criteria is of small dimensions and can be designed rigourously through the exact synthesis of the equivalent electrical network. The device is also capable of being on board a satellite, since it does not need dielectric parts, which have thermomechanical behavior which is not easily predictable owing to expansions, ageing, soldering operations, etc.

The present invention provides a coaxial-waveguide phase shifter which comprises a coaxial waveguide section, having external and internal hollow cylindrical conductors between which a number of irises parallel to each other are inserted.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
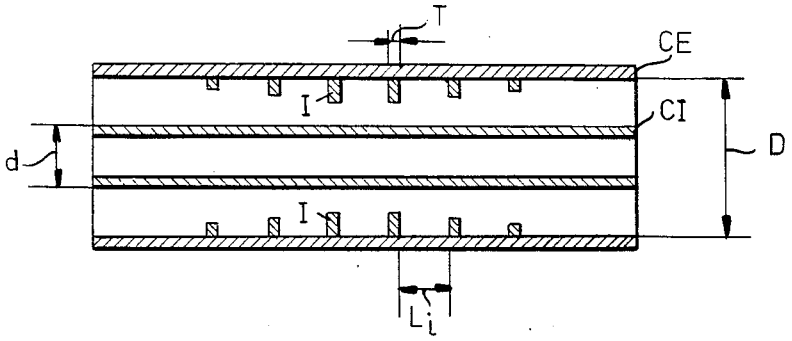
FIG. 1 is a longitudinal section through the phase shifter of the invention.
Figure 2:
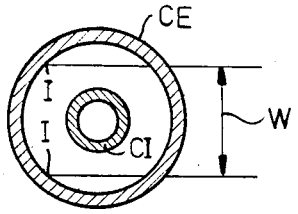
FIG. 2 is a cross section of the phase shifter.
Figure 3A:
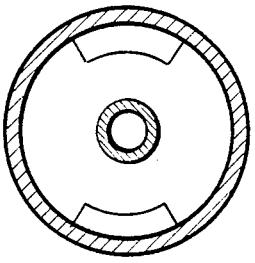
FIGS. 3*a*–3*e* are cross sections which show differently-shaped irises.
Figure 3B:
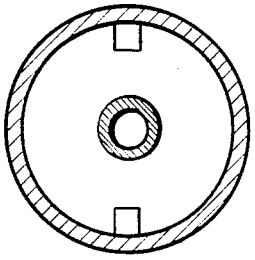

As shown in FIG. 1, the phase shifter consists of a coaxial guide section, comprising an external cylindrical conductor CE as well as an internal cylindrical conductor CI, both hollow. The internal diameter of the external conductor and the external diameter of the internal conductor are represented at D and d respectively. A plurality N of irises I, are fixed to the external guide. They consist of two opposite plates having the shape of circular segments with rectilinear sides parallel (see FIGS. 2 and 3*a*, 3*b*). The rectilinear sides are separated by a distance W and the spacing between the irises is Li.

The electrical behaviour of the phase shifter depends on the above mechanical parameters, and more particularly on W/D, D/d, T of each iris and on Li and N, which must be accurately defined while designing it. Up to now, the design and optimazation of rectangular or circular waveguide phase shifters have chiefly experimentally carried out, following rather slow and expensive procedures. Besides, implementing broad-band devices considerably long structures were produced, since the electrical models used were not capable of representing structures with irises very close to each other.

A design method which is convenient in avoiding these disadvantages will be now described.

It is necessary first select a total phase shift $\alpha$TOT to be introduced by the phase shifter, for instance 90 or 180 degrees, the frequency band F1–F2, at which the device is to operate, number N of irises to be inserted into the guide and the distribution of phase shifts $\alpha i$ alloted to each iris along the guide, e.g. a choice is possible between uniform, binomial, tapered distributions or the like, as a function of the performance criterial required as to return losses and bandwidth.

Starting from a matched load and from the last phase shift $\alpha$N to be obtained, W/D and L values relating to the last iris can be obtained by using previously prepared design data. For this purpose quadripole equivalent of the cell composed of the guide section and of the iris is derived by expressing the reactances which form it as a function of the mechanical charateristics of the iris. The relations obtained allow a build up of curves of the phase shift $\alpha i$ introduced by the cell as a function of W/D and T of the iris, where the frequency forms the plotted parameter. These curves can be then directly used or even better, computer-memorized and used in an automated design phase.

The next step is that of implementing the phase shift $\alpha$N-1 by combining in cascade the two cells, to obtain new values W/D and L relating to the next to the last iris. Since in this case the load is no longer matched due to the presence of the last iris, it is necessary to calculate the phase shift of the single cell taking into account multiple reflections. Even in this case it is possible to build up the curves of the phase shift to be obtained in function of the phase shift of the isolated single cell where the reflection coefficient is the plotted.

The process continues in this manner for the obtention of all the iris data.

The device can also use irises with a different shape from that of two opposite circular segments, provided the irises do not have radial symmetry, since they have to yield a phase shift between incident signals with orthoganal polarizations.

Figure 3C:
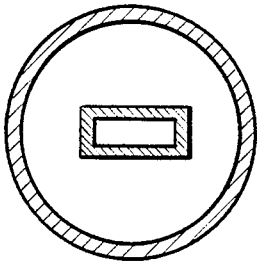
Figure 3D:
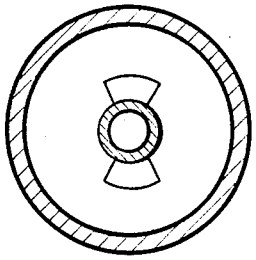
Figure 3E:
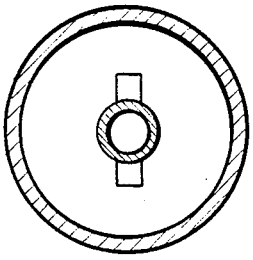

FIGS. 3*a*–3*e* show different iris shapes. The iris of FIG. 3*a* has two sectors of an annulus and the iris of FIG. 3 comprises two diametrically opposite rectangular plates. In FIG. 3*c* dissymmetry is imparted by the use of an internal waveguide which possesses a rectangular cross section. In FIG. 3*d* and in FIG. 3*e* sectors and the shape of rectangles, fixed to the internal circular waveguide.

What is claimed is:

1. A coaxial waveguide phase shifter for effecting a microwave phase shift of a predetermined angle, comprising:

an outer hollow cylindrical conductor;

an inner hollow cylindrical conductor of constant cross section over its entire length and extending coaxially to said outer cylindrical conductor within said outer cylindrical conductor and spaced with all-around clearance from said outer cylindrical conductor, said outer cylindrical conductor having a cylindrical inner surface and said inner cylindrical conductor having an outer cylindrical surface; and a plurality of mutually parallel geometrically similar and axially spaced radially asymmetrical irises in the form of diametrically opposite pairs of plates mounted on one of said surfaces and extending toward the other of said surfaces but having free edges spaced therefrom, said irises being dimensioned to effect respective partial phase shifts cumulating to a total phase shift of said predetermined angle, said one of said surfaces being circumferentially continuous and exposed between the pairs of plates constituting successive irises along said phase shifter.

2. The coaxial waveguide phase shifter defined in claim 1 wherein each of the plates of each of said irises has a shape of a cylindrical segment wherein the respective free edge is rectilinear and the rectilinear free edges of the plates of each iris are mutually parallel.

3. The coaxial waveguide phase shifter defined in claim 1 wherein each of the plates has a shape of a segment of a circular annulus, said plates are affixed to said inner surface of said outer waveguide and said free edges are circular arcs.

4. The coaxial waveguide phase shifter defined in claim 1 wherein each of the plates has a shape of a circular sector and said plates are affixed on said outer surface of said inner waveguide.

5. The coaxial waveguide phase shifter defined in claim 1 wherein each of the plates has a generally rectangular shape and is affixed to said outer surface of said inner waveguide.

6. A coaxial waveguide phase shifter for effecting a microwave phase shift of a predetermined angle, comprising:

an outer hollow cylindrical conductor; and an inner hollow conductor of constant rectangular cross section over its entire length and extending coaxially within said outer cylindrical conductor and spaced with all-around clearance from said outer cylindrincal conductor and dimensioned to distribute partial phase shifts along its length cumulating to a total phase shift of said predetermined angle.

* * * * *